US006224701B1

(12) United States Patent
Bryant et al.

(10) Patent No.: US 6,224,701 B1
(45) Date of Patent: May 1, 2001

(54) MOLDED PLASTIC SIDING PANEL

(75) Inventors: David A. Bryant, Mount Sterling; Daniel J. Ernst, Sidney; George A. Griman, Troy, all of OH (US)

(73) Assignee: Alcoa Inc., Pittsburgh, PA (US)

( * ) Notice: Subject to any disclaimer, the term of this patent is extended or adjusted under 35 U.S.C. 154(b) by 0 days.

(21) Appl. No.: 09/392,004

(22) Filed: Sep. 8, 1999

(51) Int. Cl.[7] ..... B32B 31/16
(52) U.S. Cl. ..... 156/73.1; 156/227; 156/242
(58) Field of Search ..... 156/73.1, 196, 156/217, 227, 242; 264/442, 443, 445

(56) References Cited

U.S. PATENT DOCUMENTS

| | | | | |
|---|---|---|---|---|
| 4,076,569 | * | 2/1978 | Buchbinder | 156/242 |
| 4,096,011 | * | 6/1978 | Sanders et al. | 156/196 |
| 4,457,797 | * | 7/1984 | Hatchadoorian et al. | 156/242 |
| 4,864,787 | | 9/1989 | Bukowski | 52/284 |
| 5,012,623 | | 5/1991 | Taylor | 52/531 |
| 5,072,562 | | 12/1991 | Crick | 52/533 |
| 5,455,099 | | 10/1995 | Banner | 28/122 |
| 5,537,792 | | 7/1996 | Moliere | 52/531 |
| 5,575,127 | | 11/1996 | O'Neal | 52/520 |

* cited by examiner

*Primary Examiner*—James Sells
(74) *Attorney, Agent, or Firm*—Glenn E. Klepac

(57) ABSTRACT

A molded plastic panel for covering an exterior building wall includes a laterally directed lead fin, a laterally extending groove below the lead fin, and a rearwardly directed middle wall between rows of simulated shingles, all for joining laterally adjacent panels. A side flange extending outwardly of the panel may also be included. The molded plastic panel preferably also includes at least one row of simulated shingles separated by a plurality of gaps each having a randomly varying width in order to camouflage spacings between adjacent panels that change because of thermal contraction and expansion. In a particularly preferred embodiment, the panel body includes a locking tab and a folding flange. The folding flange includes a locking tip for engaging a locking tab on an adjacent panel and a flexible hinge connecting the locking lip to the panel body. The flexible hinge allows the folding flange to be disconnected from the locking tab when replacing a single panel.

12 Claims, 7 Drawing Sheets

MOLDED PLASTIC SIDING PANEL

FIELD OF THE INVENTION

The present invention relates to molded plastic siding panels for covering exterior walls on buildings.

BACKGROUND OF THE INVENTION

Molded plastic siding panels for exterior building walls are known in the prior art. These molded panels are made from synthetic thermoplastic polymers, including polypropylene, polyethylene, and various mixtures and copolymers thereof.

Laterally elongated molded plastic panels are nailed to a wall support surface in horizontal rows partially overlapping each other in order to provide a pleasing appearance combined with a water-resistant protective layer over the support surface.

The molded plastic panels are typically installed by nailing several adjacent courses to a wall support surface, starting with a bottom course. A lower marginal edge region of each panel in courses above the bottom course overlaps a panel in the course immediately below. Side marginal edge regions of each panel overlap side marginal regions of adjacent panels.

Various mechanisms have been proposed for interlocking lower marginal edge regions of the plastic panels with panels in the course immediately below. One disadvantage of prior art interlocking mechanisms is that when one panel is damaged and must be replaced, at least one other panel must also be removed. Accordingly, there still remains a need for a means for interlocking adjacent upper and lower regions of plastic panels that allows for removal and replacement of only a single panel without affecting the other panels.

Overlapping side marginal edge regions of adjacent plastic panels has also posed problems in the prior art. Because the panels are relatively long, locking the panels together in their side marginal edge regions may cause bowing after installation when the panels undergo thermal expansion. Thermal expansion contraction accompanying temperature changes may also fracture overlapped portions of the panels unless suitable accommodations are provided for panel movement.

The panels commonly include a plurality of rows of simulated wood shingles in which individual shingle elements are spaced apart by gaps of identical width. Because all panels are produced by a single mold, they have an identical appearance from panel to panel. This identical width of all gaps and the identical appearance from panel to panel have heretofore made more readily noticeable the spacings between elements of laterally adjacent panels accompanying temperature variations. Accordingly, there still remains a need for molded plastic panels that will camouflage any spacings accompanying thermal contraction and expansion.

A principal objective of the present invention is to provide a molded plastic panel having an interlock mechanism locking the panel firmly in place, yet still permitting replacement of the panel if it becomes damaged without removing or damaging adjacent panels.

A related objective of the invention is to provide a molded plastic panel having side marginal edge regions for interlocking laterally adjacent plastic panels without bowing or fracturing the panel during installation or upon thermal expansion and contraction.

A further objective of the invention is to camouflage spacings of varying width between adjacent panels resulting from thermal expansion and contraction.

Another objective of the invention is to provide a process for making a molded plastic panel including an attachment hem having at least one locking tab, without any through openings in the attachment hem behind the locking tab.

Additional objectives and advantages of the invention will become apparent to persons skilled in the art from the following detailed description.

SUMMARY OF THE INVENTION

In accordance with the present invention, there is provided a thermoplastic panel for covering exterior walls on buildings. The panel is made from a thermoplastic polymer selected from the group consisting of polyolefins, polycarbonate, polyvinyl chloride, and mixtures and copolymers thereof. Polyolefins, especially polypropylene in mixtures and copolymers with polyethylene, are particularly preferred. The thermoplastic panel is preferably manufactured by injection molding.

The thermoplastic panel includes a body, an attachment hem or nailing hem adjacent an upper portion of the body, a locking tab attached to the attachment hem, and a folding flange attached to a lower portion of the body.

The attachment hem is preferably adjacent an upper portion of the body. The attachment hem defines a plurality of spaced, laterally elongated attachment slots or nailing slots for attaching the panel to an exterior building wall.

A locking tab attached to the hem includes a downwardly extending lower leg portion and a forwardly extending upper leg portion connecting the hem with the lower leg portion. The lower leg portion defines an arcuate socket facing rearwardly of the panel. In a preferred embodiment, a plurality of outwardly extending ribs connect the locking tab with a front surface portion of the attachment hem.

A folding flange attached to a lower portion of the body includes a forwardly facing locking lip for engaging a socket in the locking tab on an adjacent panel and a hinge connecting the locking lip with the body. The hinge is formed integrally with the lip and the body and has lesser thickness than the lip or the body.

The hinge preferably has less than half the thickness of the body or the locking lip. In a particularly preferred panel wherein a portion of the body supporting the hinge has a thickness of about 0.070 inch, the hinge has a thickness of about 0.010–0.020 inch. The preferred embodiment also includes a hinge support web extending rearwardly of a front surface portion of the body. The hinge support web supports the hinge and the hinge supports the locking lip. The hinge extends about 1/16 inch (0.063 in.) between the hinge support web and the locking lip.

The panel body includes at least one laterally extending row of simulated shingles. The shingles each have a bottom wall extending between two side walls, and a front surface portion including a bottom end portion adjacent the bottom wall and a top end portion spaced upwardly from the bottom wall.

A particularly preferred panel body includes an upper row and a lower row of simulated shingles. A ledge, generally coplanar with the bottom wall of the upper row of shingles, extends rearwardly of the bottom end portion.

A lead fin extends laterally outwardly of the upper row of simulated shingles. The lead fin has a lateral end spaced laterally outwardly of the upper row. A groove below the lead fin extends between the lateral end and the upper row. Plastic panels of the invention fit together with a middle ledge of a first panel engaging a lead fin of a second panel adjacent the first panel.

A particularly preferred plastic panel includes at least one laterally extending row of simulated shingles having a simulated wood appearance. A panel with two rows of simulated shingles is most preferred. The simulated shingles each include a bottom wall extending between longitudinally extending shingle side walls. The side walls preferably are generally parallel to each other and to adjacent side walls on other shingles in each row.

Opposed side walls on adjacent simulated shingles define a plurality of gaps each having a predetermined width, defined herein as the average distance between opposite side walls. These gaps each have a width that varies randomly within predetermined limits in order to camouflage the lateral spacings between adjacent panels that vary because of thermal contraction and expansion. For example, systems mounted with ¼ inch average lateral spacings between shingles in adjacent panels will have gaps between adjacent simulated shingles averaging about a ¼ inch width. However, the gap width varies randomly between about ⅛ inch and ⅝ inch, thereby camouflaging spacings that vary because of thermal contraction and expansion.

In an alternative embodiment of the invention, the plastic panel is injection molded to include a body having side walls on opposite lateral sides, a top wall extending between the side walls, and an elongated strip extending outwardly of the top wall. The strip includes a locking tab spaced from the top wall and a laterally extending folding hinge between the locking tab and the top wall. The folding hinge extends between the side walls and has reduced thickness compared with the remainder of the strip.

The strip is folded along the folding hinge so that adjacent opposed surfaces on the strip define a fastening line. The opposed surfaces are then joined together by heat or ultrasound or mechanically to form an integral structure.

An important advantage of this embodiment is that the locking tab can be made continuous, extending without interruption between the side walls and without any openings behind the locking tabs.

DETAILED DESCRIPTION OF PREFERRED EMBODIMENTS

The present invention is directed to an improved molded plastic siding panel for covering exterior walls on buildings.

Figure 1:
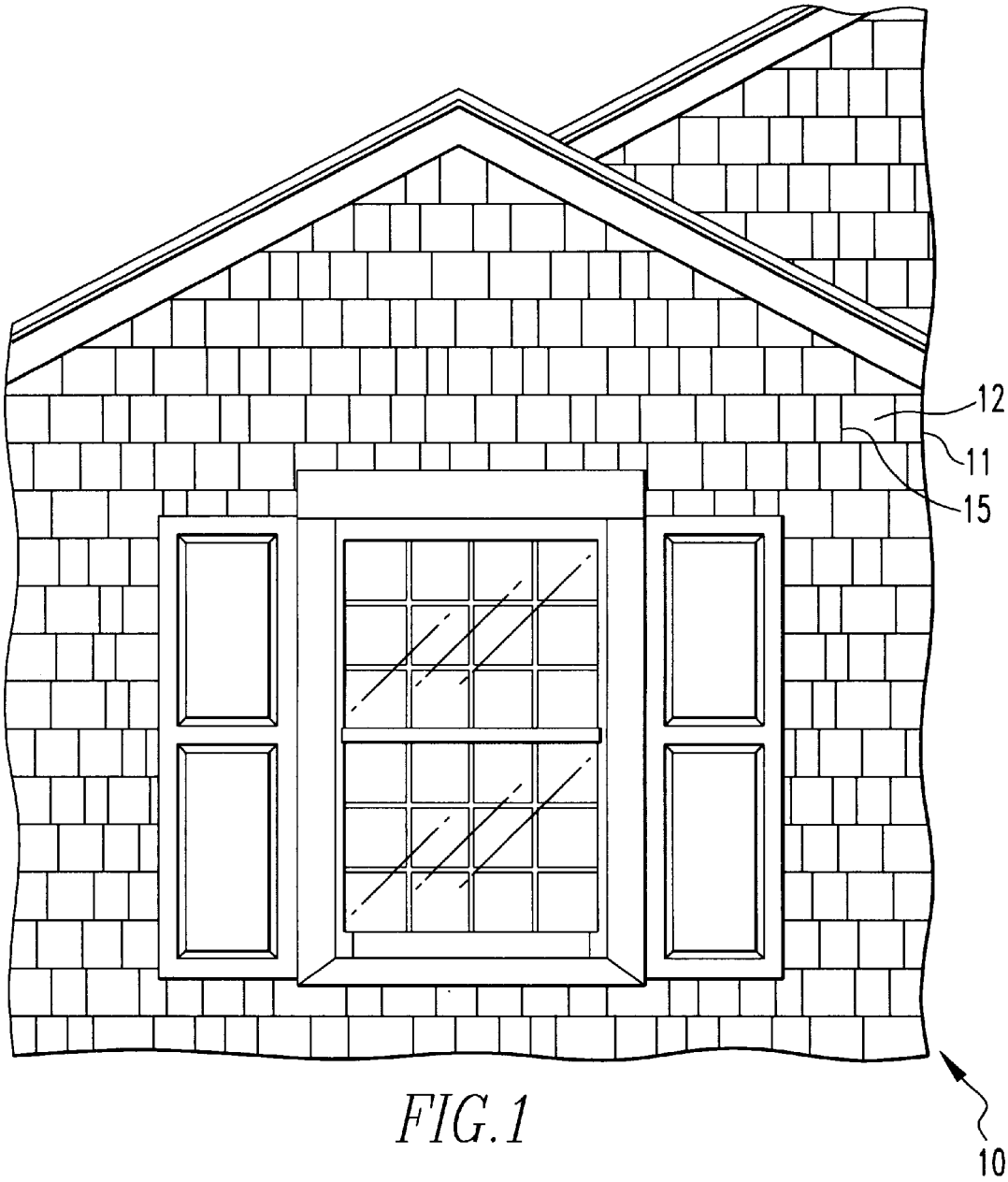
FIG. 1 is a fragmentary front elevational view of a building wall covered with plastic panels made in accordance with the present invention.

Referring now to the drawings, there is shown in FIG. 1 an exterior wall 10 covered by several plastic panels 11 of the invention. The panels 11 each include two laterally extending generally parallel rows of simulated wood shingles 12. The shingles 12 have irregular widths and they are separated from shingles in the same row by vertically extending gaps 15 of varying width. The panels 11 may cover an entire exterior wall as shown in FIG. 1 or they may be combined with other exterior wall coverings such as vinyl siding, or with various other materials including brick, aluminum, ceramic tile, and the like.

Figure 2:
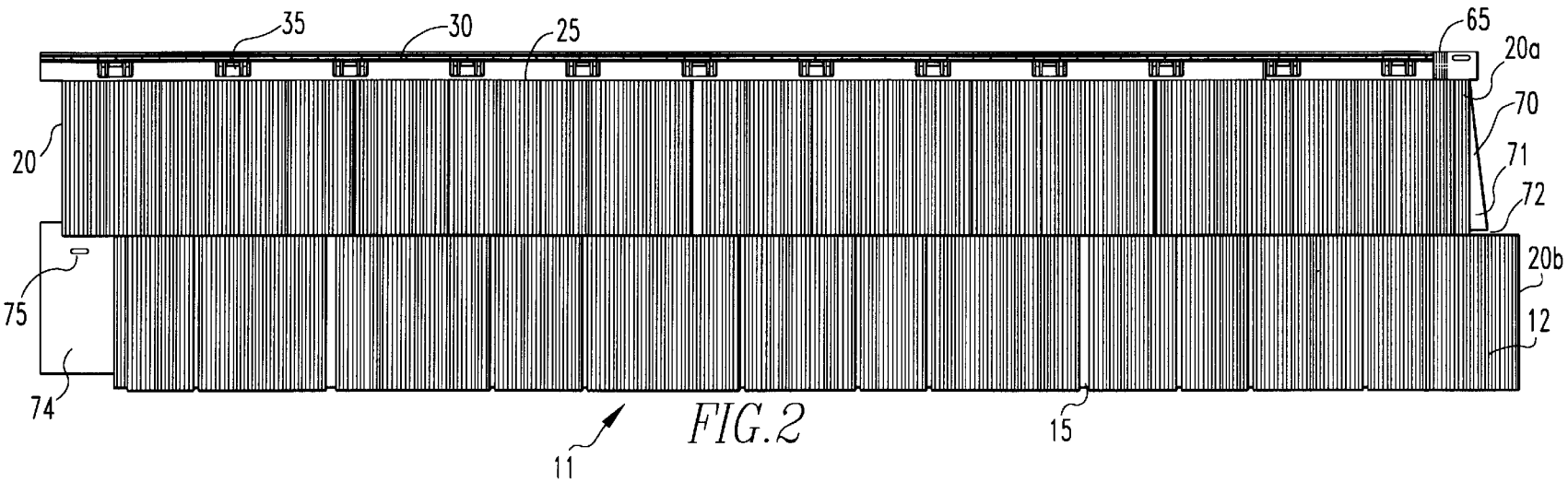
FIG. 2 is a front elevational view of a plastic siding panel of the invention.
Figure 3:
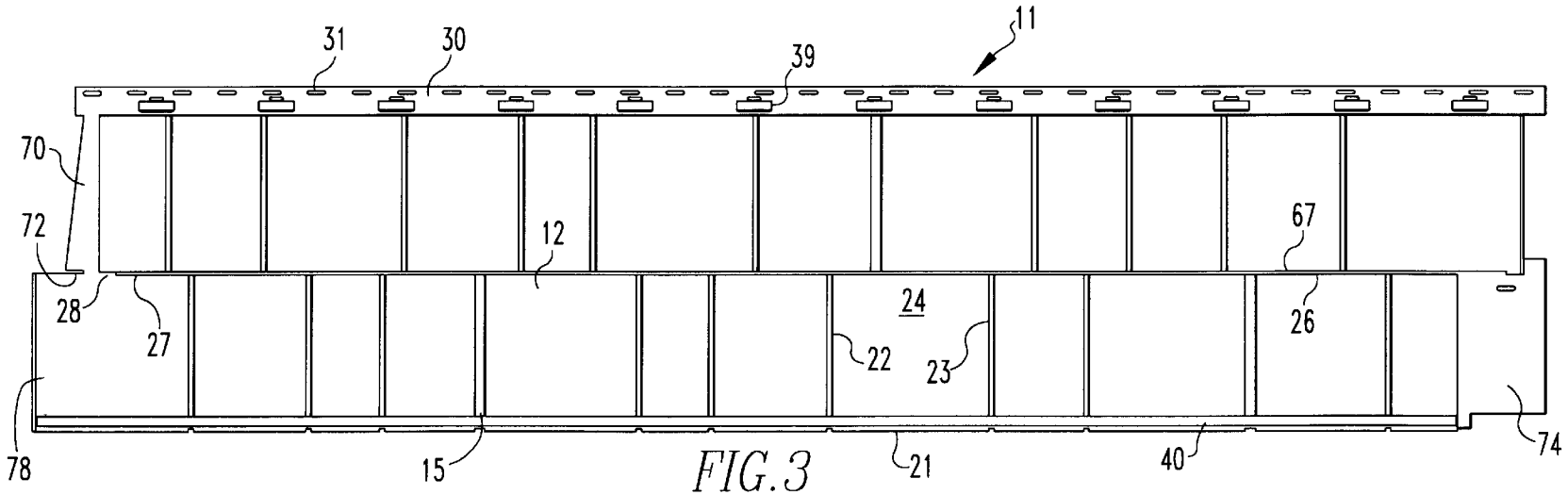
FIG. 3 is a rear elevational view of the plastic siding panel of FIG. 2.

One of the panels 11 is shown in greater detail in FIGS. 2–4. The panel 11 includes a body 20 divided into two generally parallel, laterally extending rows 20*a*, 20*b* of simulated wood shingles 12. The shingles 12 in the lower row 20*b* each include a bottom wall 21 extending between opposed side walls 22, 23 and a front wall or front surface portion 24 extending upwardly from the bottom wall 21. Shingles 12 in the upper row 20*a* also include a top wall 25. A laterally extending middle wall 26 extends between the upper row 20*a* and the lower row 20*b*.

Figure 4A:
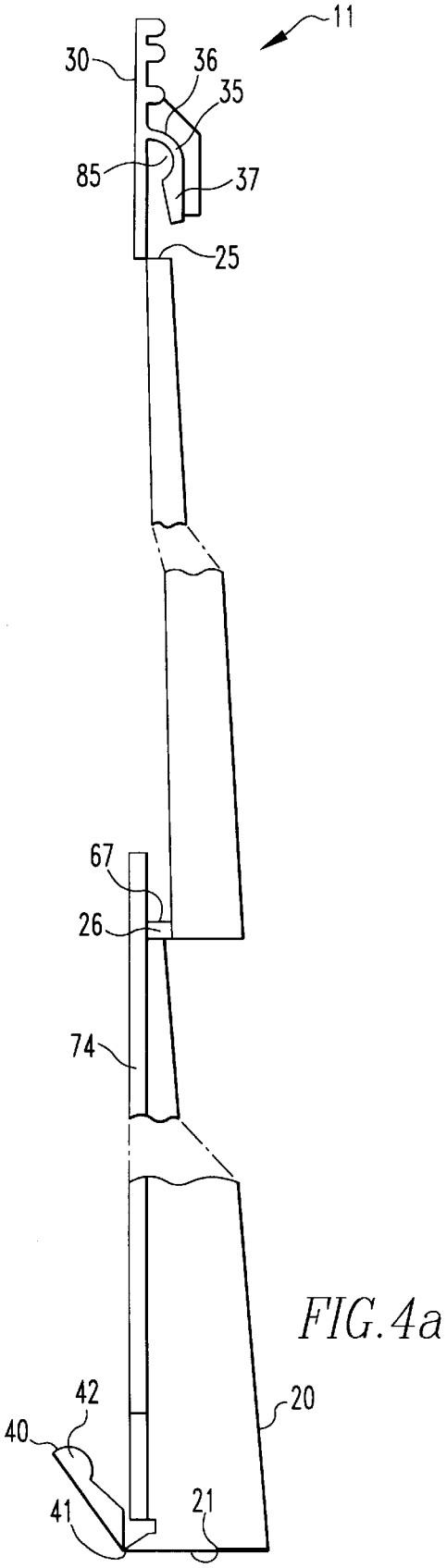
FIG. 4*a* is a left side elevational view of the plastic panel of FIG. 2.
Figure 4B:
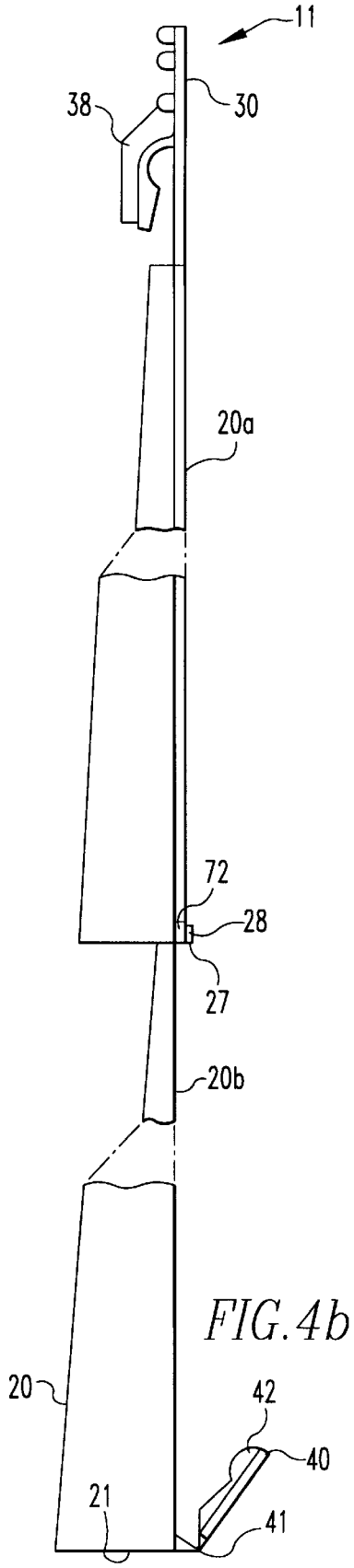
FIG. 4*b* is a right side elevational view of the plastic panel of FIG. 2.

As shown in FIGS. 3, 4*a*, and 4*b*, the middle wall 26 includes a rearwardly extending locating ridge 27 having a lateral end portion or lateral end 28. The lateral end portion 28 abuts against a side flange 74 on a panel adjacent the plastic panel 11.

Opposed side walls 22, 23 on adjacent simulated shingles 12 define gaps 15 of varying width. Width of the gaps 15 varies randomly within predetermined limits in order to camouflage spacings between adjacent panels accompanying thermal contraction and expansion. In prior art panels having identical or nearly identical shingle gaps, the spacings between adjacent panels are more readily noticeable.

As shown in FIGS. 2 and 3, the panel 11 also includes an attachment hem or nail hem 30 adjacent the top wall 25. The nail hem 30 defines several laterally elongated, laterally spaced nail slots 31 for nailing the panel 11 to a building wall.

Several locking tabs 35 are attached to the hem 30 at laterally spaced intervals. The locking tabs 35 each include a forwardly extending upper leg portion 36 adjacent the hem 30 and a downwardly extending lower leg portion 37. Several forwardly extending ribs 38 also connect the locking tab 35 with the nail hem 30.

As shown in FIG. 3, the nail hem 30 defines an opening 39 behind each locking tab 35.

A bottom wall 21 of the lower row 20*b* extends rearwardly of the body 20. The bottom wall 21 serves as a hinge support web for a folding flange 40. The folding flange 40 includes a flexible hinge 41 connecting the support web 21 with a locking lip 42.

The flexible hinge 41 may have a thickness of about 0.010–0.020 inch and is about 0.015 inch thick in the preferred embodiment shown. The hinge support web 21 has a thickness of about 0.063 inch.

Figure 5:
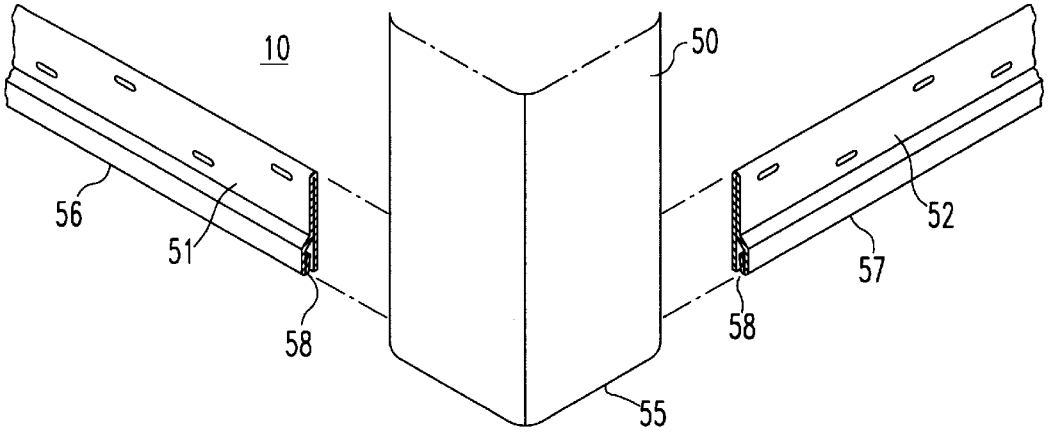
FIG. 5 is a fragmentary, perspective view of an exterior building wall.

As shown in FIG. 5, a plastic corner post 50 and metal starter strips 51, 52 are installed on an exterior building wall 10 before the panels are hung. Alternatively, the corner post 50 may be made from an aluminum alloy or other metal, and the starter strips 51, 52 may be made from polyvinyl chloride or other plastic material. The corner post 50 has a bottom edge 55 extending below lower edges 56, 57 of the starter strips 51, 52. A lateral spacing of about ½ inch is provided between the corner post 50 and the starter strips 51, 52 in order to allow for thermal expansion. The starter strips each include a downwardly opening groove 58 that will engage locking lips of folding flanges on the plastic panels.

Figure 6:
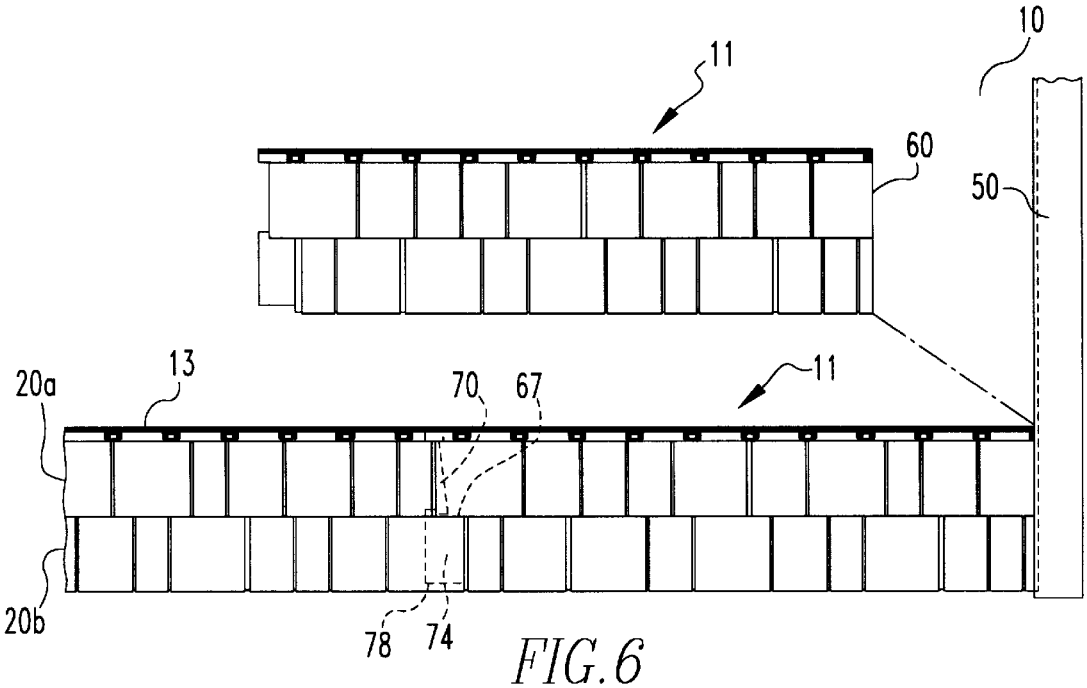
FIG. 6 is a fragmentary, front elevational view of an exterior building wall covered with plastic siding panels of the invention.

Referring now to FIG. 6, the plastic panels 11, 13 are hung on a wall 10 starting by making a vertical cut on the right side of a first panel 11, resulting in a right edge 60 extending about ¼ inch into the corner post 50. A ¼ inch clearance into the corner post 50 allows for panel movement caused by temperature changes. A second panel 13 is hung to the left of the first panel 11, with edge portions of the two panels 11, 13 interlocking as described below in greater detail. An alignment gauge 65 on the nail hem 30 (shown in FIG. 2) determines the location of the next panel, based upon temperature during installation.

As shown in FIGS. 2–4*b*, the panels 11 include an upper row 20*a* and a lower row 20*b* of simulated shingles. The upper row 20*a* has a middle wall 26 extending rearwardly and having a top surface comprising a middle ledge 67. The panel 11 also includes a lead fin 70 having a lateral end 71 extending laterally outwardly of the upper row 20*a* and a groove 72 below the lead fin 70. The lower row 20*b* has a side flange 74 extending leftwardly. The side flange 74 includes a nail slot 75 for nailing the flange 74 to the wall 10.

Referring again to FIG. 6, a lead fin 70 of the second panel 13 abuts against and is supported by a middle ledge 67 on the first panel 11. A right side 78 of the lower row 20*b* on the second panel 13 overlaps a side flange 74 on the first panel 11. A lateral end portion 28 of a locating ridge on the second panel 13 abuts against the side flange 74 on the first panel 11.

Figure 7:
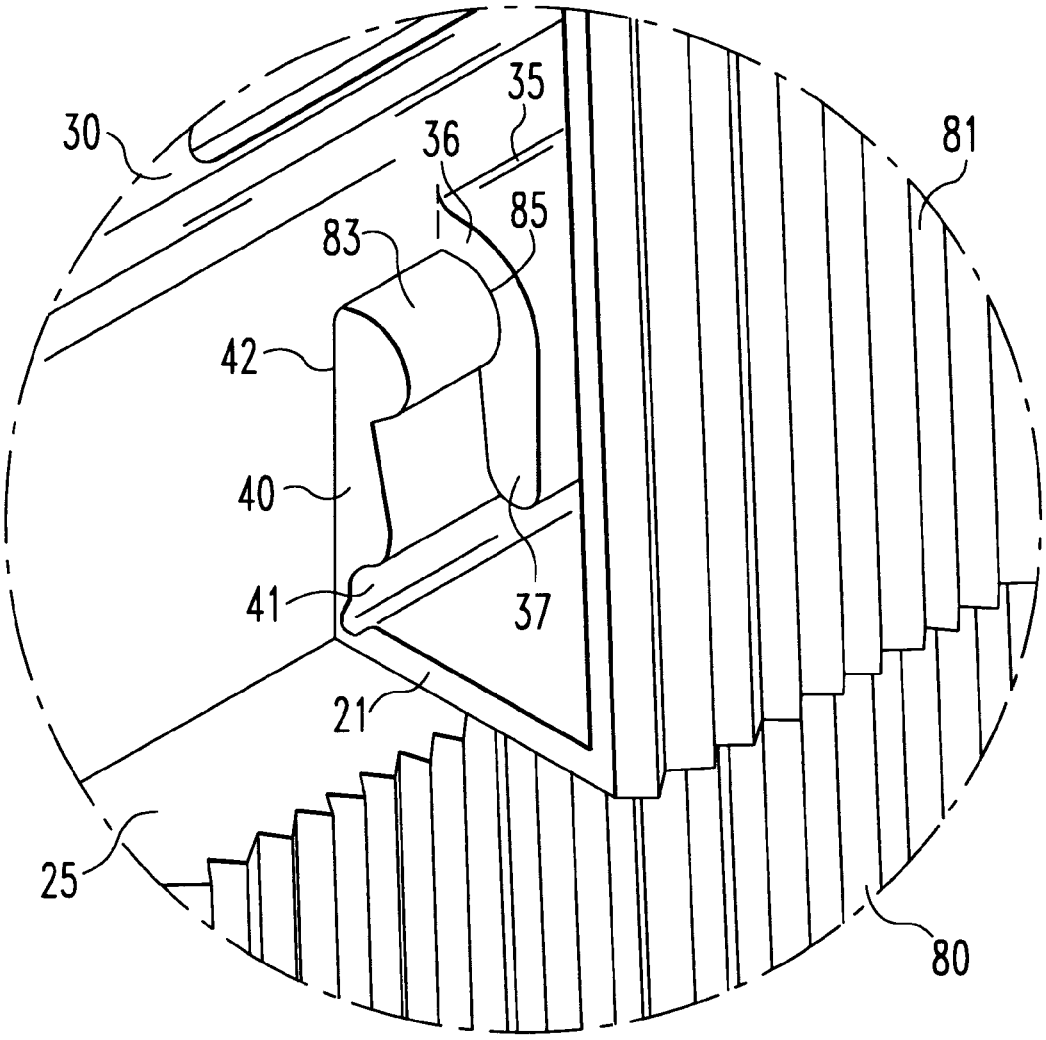
FIG. 7 is a fragmentary, perspective view of a locking tab joined with a folding flange of the invention.

After the lowermost course of panels is installed, a second course of plastic panels is installed above them. Locking tabs 35 on the first course 80 are engaged with folding flanges 40 on the second course 81, as shown in FIG. 7. The locking lips 42 on the flanges 40 each include an arcuate, outwardly extending plug 83 joined with an arcuate, inwardly extending socket 85 on the locking tab 35.

The flexible hinge 41 allows the folding flanges 40 to be disengaged from the locking tabs 35, when desired. For example, if one of the panels is damaged by weather or mechanical trauma, a homeowner may wish to replace the single damaged panel without disturbing other panels adjacent the damaged one.

Figure 10:
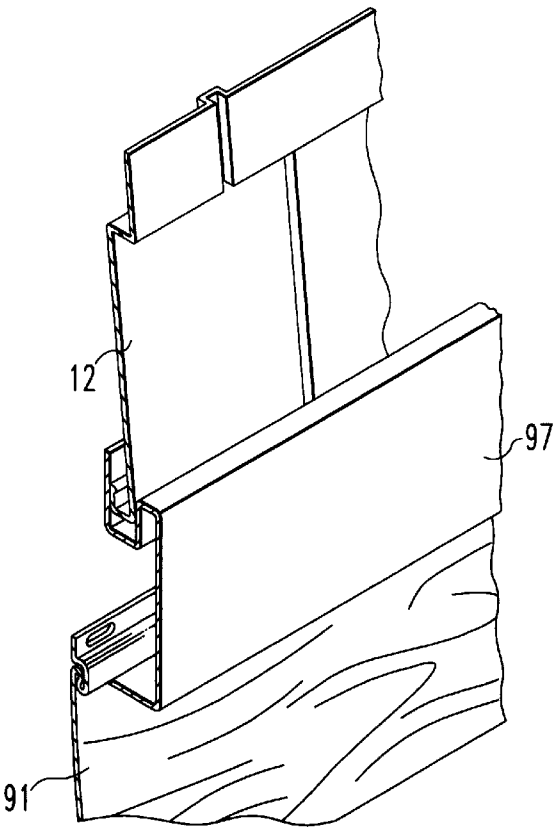
FIGS. 8–10 are fragmentary perspective views of transition regions between a plastic siding panel of the present invention and a conventional siding panel.
Figure 9:
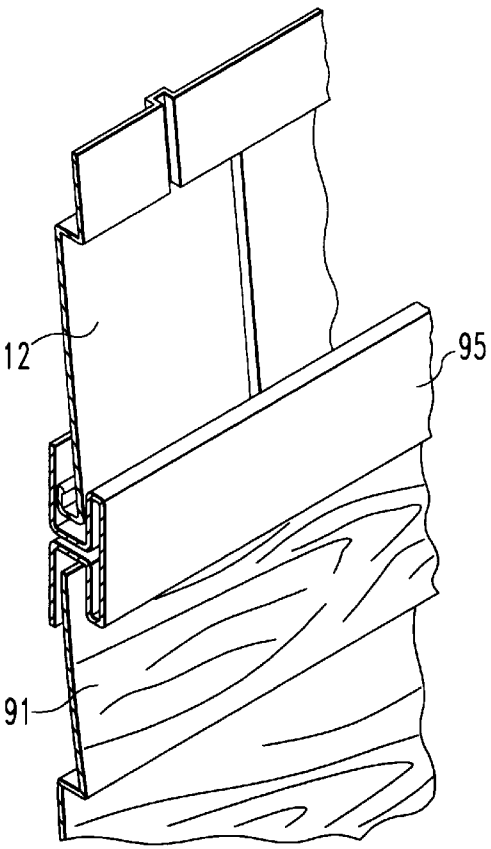
Figure 8:
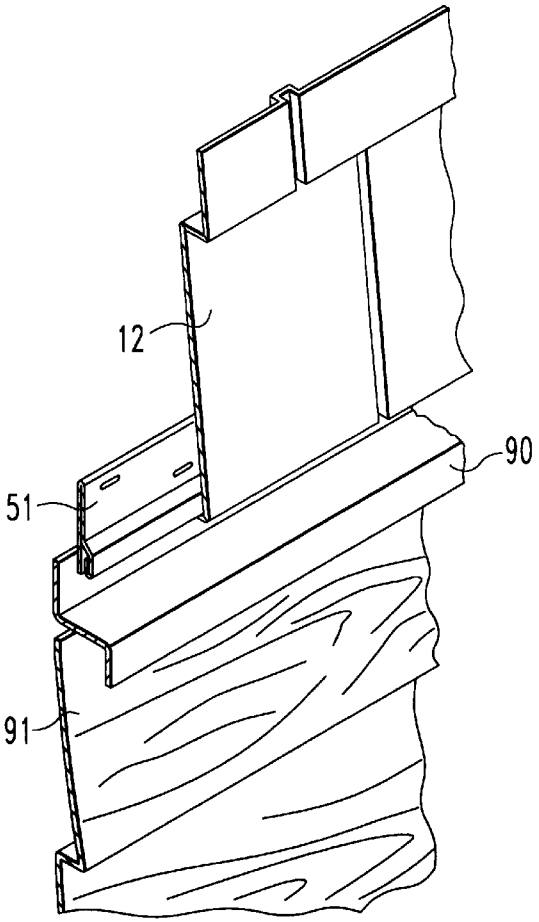

Various options for installing molded plastic panels of the invention adjacent courses of conventional vinyl siding panels are shown in FIGS. 8, 9 and 10. In FIG. 8, a drip cap 90 and a starter strip 51 are positioned between the vinyl siding panel 91 and the molded plastic panel 12.

In FIG. 9, a T-channel 95 is installed between the vinyl siding panel 91 and the molded plastic panel 12.

In FIG. 10, a lineal 97 is installed between the vinyl siding panel 91 and the molded plastic panel 12.

Figure 11:
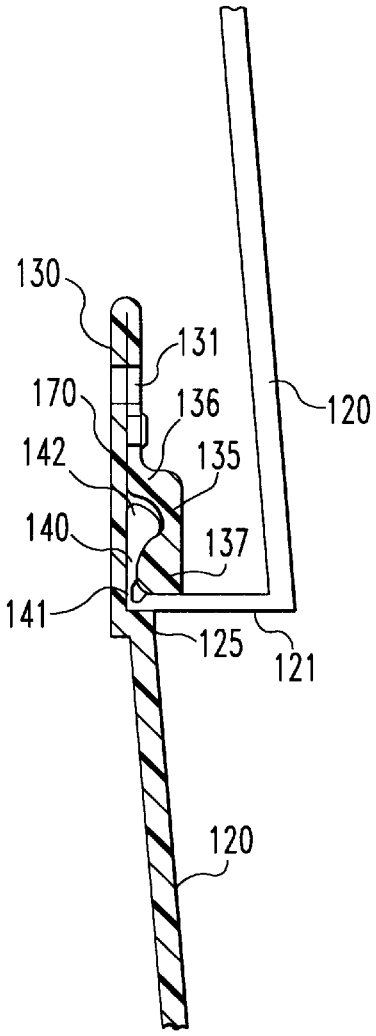
FIGS. 11 and 12 are fragmentary, side elevational views of an alternative embodiment of the invention.
Figure 12:
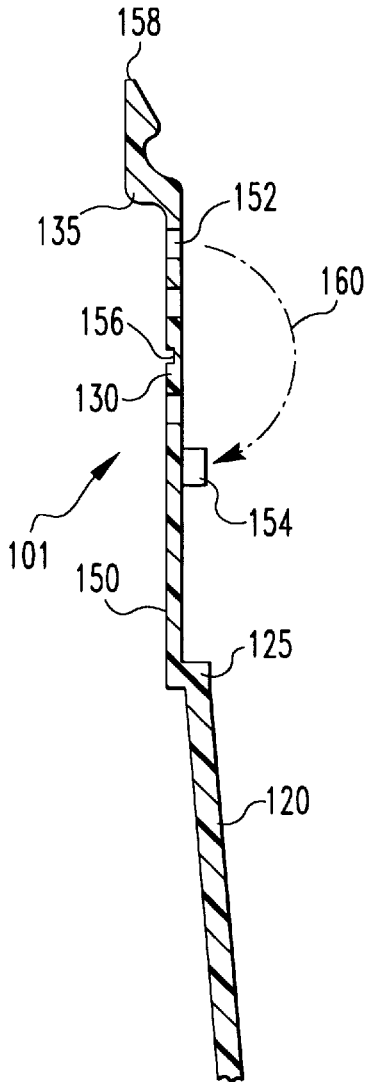

An alternative plastic panel 101 of our invention is shown in FIGS. 11 and 12. The panel 101 includes a plastic body 120 having a bottom wall 121 serving as a hinge support web for a folding flange 140. The folding flange 140 includes a flexible hinge 141 connecting the support web 121 with a locking lip 142. The panel 101 also has an attachment hem or nail hem 130 adjacent a top wall 125 of the body 120. The nail hem 130 defines nail slots 131 for nailing the panel 101 to a building wall. A locking tab 135 is molded integrally with the hem 130. The locking tab 135 includes a forwardly extending upper leg portion 136 adjacent the hem 130 and a downwardly extending lower leg portion 137, all similar to the panel 11 described above.

As shown in FIG. 12, the hem 130 and locking tab 135 are manufactured by a process in which the hem 130 and locking tab 135 are initially injection molded as an elongated strip 150 extending outwardly from the top wall 125. The strip 150 connects a locking tab 135 to the top wall 125. The strip 150 includes openings 152 and bosses 154 located at laterally spaced locations. A narrow folding hinge or folding area 156 extends about halfway between the top wall 125 and the top end 158 of the strip 150. The folding hinge typically has a thickness of about 0.010 to 0.020 inch.

After the strip 150 is molded, the top end 158 is folded in the direction of the arrow 160 shown in FIG. 12 so that the rivets 154 fit inside the openings 152. The rivets 154 are molded slightly larger than the openings 152 in order to assure a tight fit. Finally, after the strip 150 is folded over as shown in FIG. 11, opposed surfaces along the fastening line 170 are joined together by heat or ultrasound or by mechanical means to provide an integral structure.

The single locking tab 135 shown in FIGS. 11 and 12 preferably extends across the entire width of the panel 101. In contrast, the locking tabs 35 shown in FIGS. 2 and 3 each have a width of only about 2 inches, separated by spacings of about 3½ inches. The hem 130 shown in FIG. 11 is preferably continuous, uninterrupted by any through openings behind the locking tab 135. The locking tab 135 is preferably continuous, extending between spaced lateral ends of the attachment hem 130.

Having described the presently preferred embodiments, it is to be understood that the invention may be otherwise embodied within the spirit and scope of the appended claims.

What is claimed is:

1. A process for making a plastic siding panel comprising a body, an attachment hem, and a locking tab attached to the attachment hem, said process comprising:

(a) molding a plastic panel comprising a body having side walls, a top wall extending between said side walls, and a strip extending outwardly of said top wall, said strip including a locking tab spaced from said top wall and a laterally extending folding hinge between said locking tab and said top wall, (b) folding said strip along said folding hinge so that adjacent opposed surfaces of said strip define a fastening line, and (c) joining said surfaces along said fastening line.

2. The process of claim 1, wherein said locking tab extends continuously between said side walls.

3. The process of claim 1, wherein said folding hinge comprises an area of reduced thickness in said strip extending between said side walls.

4. The process of claim 1, wherein step (a) comprises injection molding.

5. The process of claim 1, wherein step (c) comprises joining by heat or ultrasound.

6. A process for making a plastic siding panel having a body, an attachment hem, and a locking tab attached to the attachment hem, said process comprising:

(a) providing a plastic panel comprising a body having opposed side walls, a top wall extending between said side walls, and a strip extending upwardly of said top wall, said strip including at least one locking tab spaced from said top wall and a laterally extending folding hinge between said locking tab and said top wall, said folding hinge extending between said side walls;

(b) folding said strip along said folding hinge so that adjacent opposed surfaces of said strip define a fastening line; and (c) joining said opposed surfaces along said fastening line.

7. The process of claim 6 wherein said siding panel comprises a thermoplastic polymer selected from the group consisting of polyolefins, polycarbonate, polyvinyl chloride, and mixtures and copolymers thereof.

8. The process of claim 6 wherein said panel comprises a thermoplastic polymer comprising a polyolefin selected from the group consisting of polyethylene, polypropylene, and mixtures and copolymers thereof.

9. The process of claim 6 wherein said body comprises at least one laterally extending row of shingles having a simulated wood appearance, each said shingles including a bottom wall extending laterally between a pair of longitudinally extending side walls, and wherein said side walls on opposed lateral sides of said shingles define a plurality of gaps between said shingles, each said gaps having a width varying randomly within predetermined limits in order to camouflage lateral spacings between adjacent panels accompanying thermal expansion and contraction.

10. The process of claim 9 wherein said side walls on opposed lateral sides of said shingles are generally parallel.

11. The process of claim 6 wherein said locking tab includes a downwardly extending lower leg portion.

12. The process of claim 11 wherein said siding panel further comprises a folding flange attached to a lower portion and comprising a locking lip for engaging a locking tab on an adjacent panel and a hinge connecting said lip with said body, said hinge being formed integrally with said body and having lesser thickness than said lip and said body.

* * * * *